United States Patent [19]

Ledebur

[11] 4,329,864

[45] May 18, 1982

[54] APPARATUS FOR CHANGING ROLLS IN VERTICAL ROLLING MILLS

[75] Inventor: Harry C. Ledebur, Canfield, Ohio

[73] Assignee: Wean United, Inc., Pittsburgh, Pa.

[21] Appl. No.: 176,956

[22] Filed: Aug. 11, 1980

[51] Int. Cl.[3] ..... B21B 31/12

[52] U.S. Cl. ..... 72/239; 72/238; 198/339; 100/159

[58] Field of Search ..... 72/238, 239; 100/918, 100/159; 414/911; 198/339

[56] References Cited

U.S. PATENT DOCUMENTS

| | | | |
|---|---|---|---|
| 2,011,686 | 8/1935 | Mikaelson et al. | 72/239 |
| 3,194,045 | 7/1965 | Hill | 72/238 |
| 3,196,658 | 7/1965 | Sieger et al. | 72/239 |
| 3,383,897 | 5/1968 | O'Brien | 72/238 |
| 3,490,262 | 1/1970 | Adair | 72/238 |
| 3,491,570 | 1/1970 | Beard | 72/239 |
| 4,308,741 | 1/1982 | Ishii et al. | 72/239 |

FOREIGN PATENT DOCUMENTS

| | | | |
|---|---|---|---|
| 967373 | 11/1957 | Fed. Rep. of Germany . | |
| 47-28594 | 7/1972 | Japan | 72/238 |
| 841496 | 1/1958 | United Kingdom . | |

*Primary Examiner*—Francis S. Husar
*Assistant Examiner*—Jonathan L. Scherer
*Attorney, Agent, or Firm*—Daniel Patch; Suzanne Kikel

[57] ABSTRACT

Disclosed is a vertical stand of a sizing mill for rolling seamless tube in which each roll of the mill is contained in and supported by a yoke moveable both transversely of the product passline and axially of the roll axis, the latter adjustment being performed by an elevator arranged normally at the bottom of the mill for moving both yokes as a unit with their rolls, i.e. a yoke-roll set, through the top of the stand to a roll changing position where both yokes are transferred as a unit to one of two in-lined arranged side shifting carriages supported by the stand, the arrangement being such that when a used yoke-roll set is moved away from the stand at the top thereof by one of the carriages a replacement yoke-roll set is positioned above the stand of the other carriage in readiness to be received and lowered into the stand by the elevator.

15 Claims, 8 Drawing Figures

APPARATUS FOR CHANGING ROLLS IN VERTICAL ROLLING MILLS

The present invention relates to an improved rolling mill, more particularly to an improved construction for supporting the rolls thereof and for quickly and efficiently facilitating their removal and replacement in what is generally referred to in the trade as roll changing. While the invention for purposes of description will be described in its adaptation to a vertical seamless tube sizing mill stand, it will be appreciated that it can be applied to other rolling mill and similar apparatuses.

Such vertical sizing mill stands as is the case in vertical rolling mill stands in general, in the past have not lent themselves to adaptation of normal techniques for effecting quick and efficient roll changing such as the techniques employed presently in connection with horizontal rolling mills, both for rolling strip and tubes, the main reason being the arrangement of the vertical stand and the rolls do not lend themselves to a simple horizontal removal operation or use of roll changing apparatus mounted or supported on the mill floor.

It is therefore the object of the present invention to provide in a vertical rolling mill stand an improved roll-chock supporting system for providing quick and efficient removal and replacement of the rolls.

It is another object of the present invention to provide in such a system a roll changing apparatus supported at the top of the vertical stand in a manner to receive a used pair of rolls from the stand and replacing them with a new pair of rolls.

Another object of the present invention is to provide an elevator for raising and lowering with reference to a position above the mill stand, a set of rolls and their specially designed support yokes wherein the elevator during operation of the mill is maintained below and out of contact with the yokes in an inoperative position.

It is a still further object of the present invention to provide an improved rolling mill in accordance with any one of the above objects in which the spindle for driving the rolls and the special designed driven lower ends of a new roll set to be installed in the roll stand will be maintained in proper alignment and positioned for automatic engagement when the new roll set is lowered into the stand.

A final object of the present invention is to provide in a mill stand referred to above, an improved manner of maintaining the yokes in the stand including one or more clamping or restraining means.

These objects, as well as other novel features and advantages of the present invention, will be better appreciated when the following description of the preferred embodiment of the invention is read along with the accompanying drawings of which:

Figure 1:
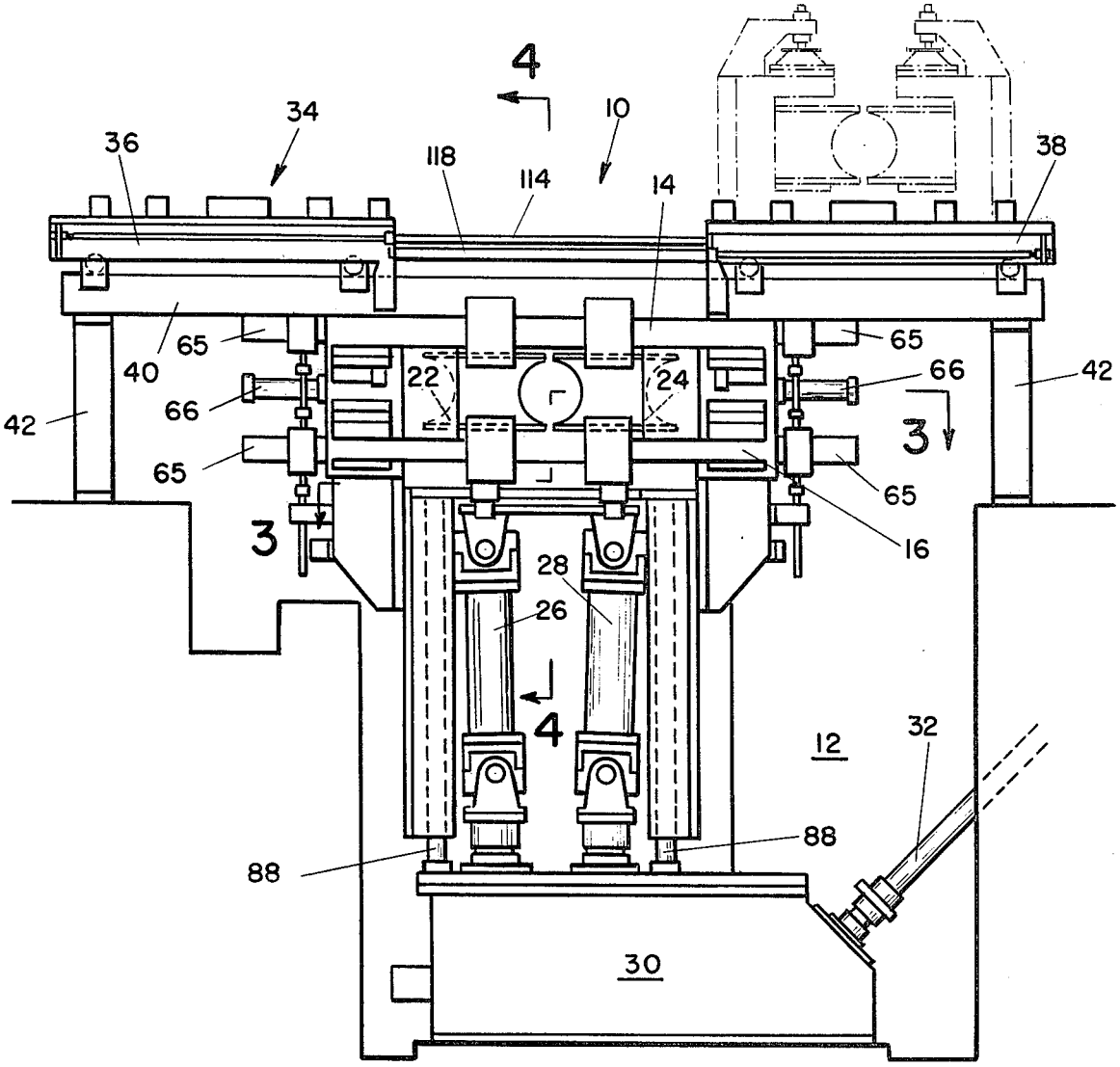
FIG. 1 is an elevational view of a vertical mill stand of a seamless sizing mill incorporating the features of the present invention.
Figure 2:
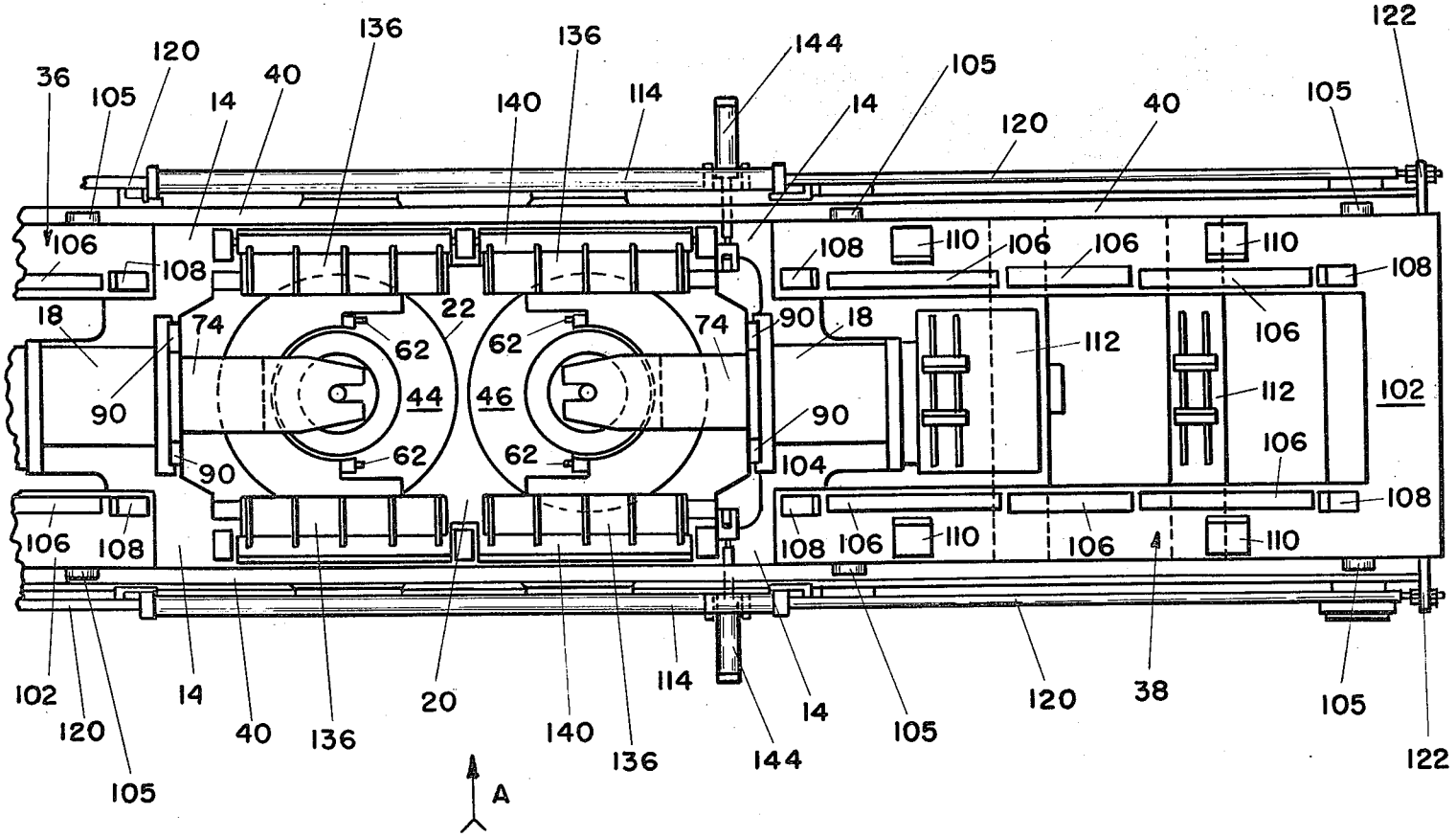
FIG. 2 is an enlarged partial plan view of the vertical stand illustrated in FIG. 1.

With reference first to FIGS. 1 and 2, there is illustrated the vertical stand 10 of a multi-stand sizing mill for rolling seamless tube from a hot incoming shell. The arrows marked "A" on the drawings indicate the direction of the path of travel of the shell relative to the mill. It will be readily appreciated by those skilled in the art, that many of the components of the stand are well known and for which reason only the elements directly involved in the improvements represented by the present invention will be described in detail.

In FIG. 1 a foundation pit 12 is provided to receive the stand 10, the foundation of which supports the stand in a manner not shown. The stand consists of two spaced apart, horizontally arranged rigid housings, 14 and 16, better shown in FIGS. 2 and 3, where there is also seen portions 18 of the outer ends of the housings that allow the housings at their ends to be rigidly joined together by bolts 19 seen in FIG. 5, to form a rigid unitary construction. While still referring to FIG. 3, each housing is provided with an extended opening or window 20, the extent of which, in the plan view, can be best seen from FIG. 2, where in the window 20 a pair of cooperative vertical roll assemblies 22 and 24 are received and adapted to be adjusted towards and away from each other according to normal practice, more about which will be said later.

Referring again to FIG. 1, the lower ends of the rolls 22 and 24 arranged so that their axes are vertically disposed, are each driven by identical spindle assemblies 26 and 28, the opposite ends of which are provided with customary universal couplings for allowing the rolls the required horizontal adjustment, which includes a predetermined position for roll changing. The lower end of the spindle assemblies 26 and 28 extend into a main gear drive 30, which is driven by a motor shaft 32, the motor for which is not shown.

At the very top of the stand 10 there is arranged a side shifting roll changing device 34 for quickly receiving and replacing the roll assemblies 22 and 24 with a replacement or new roll assemblies shown in phantom at the right in FIG. 1, supported by the side shifting device. For present purposes it is only necessary to indicate that the side shifting device 34 includes two inlined generally identical carriages 36 and 38 arranged to move horizontally above the stand 10 and toward and away from the window 20 thereof, being supported for this purpose by two parallel rails 40 which in turn are supported by the foundation through the agency of upright supports 42 and the stand itself. Thus it will be noticed that in FIG. 1 the phantom roll assemblies are actually supported by the carriage 38 and positioned in readiness to be brought over the window 20 of the stand 10.

Figure 3:
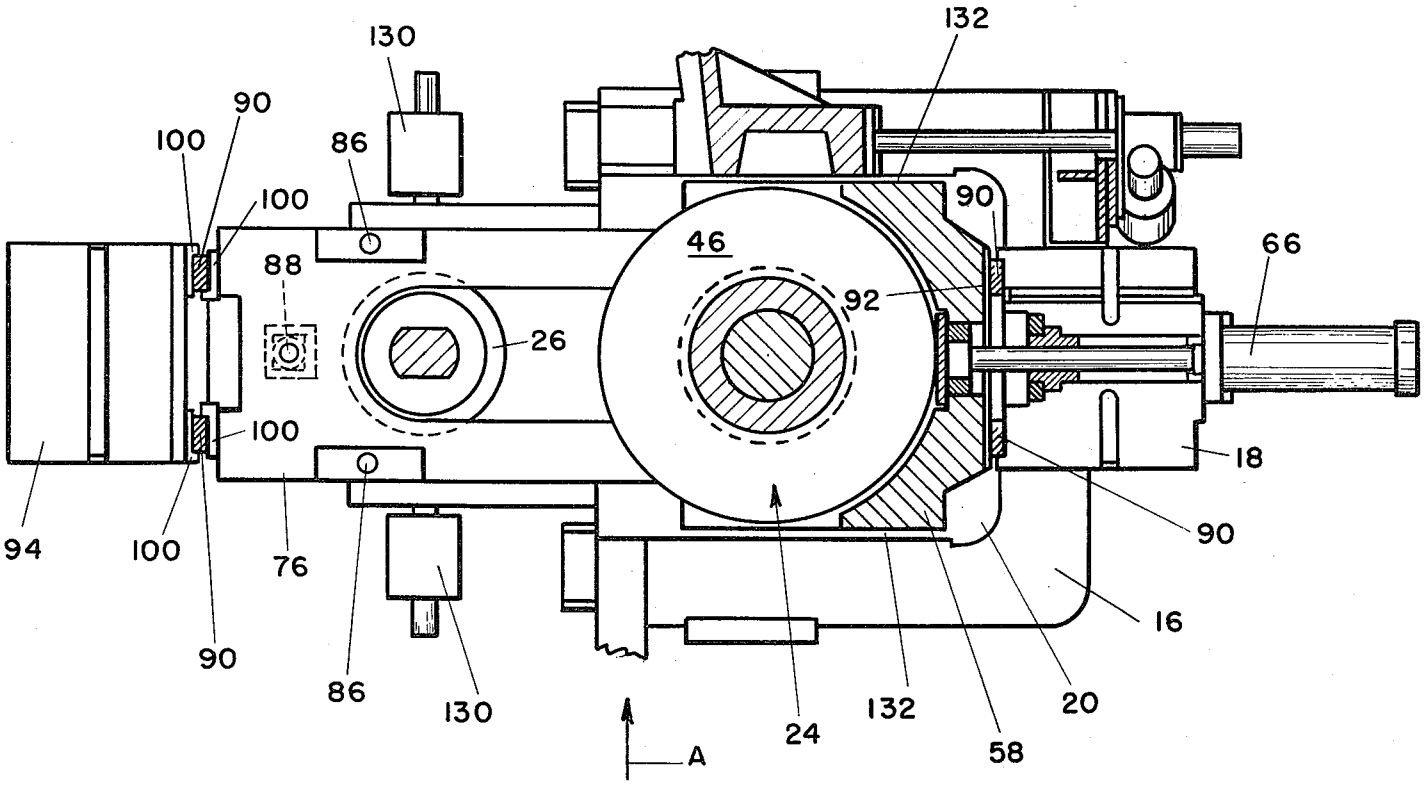
FIG. 3 is a sectional view taken on lines 3—3 of FIG. 1.
Figure 5:
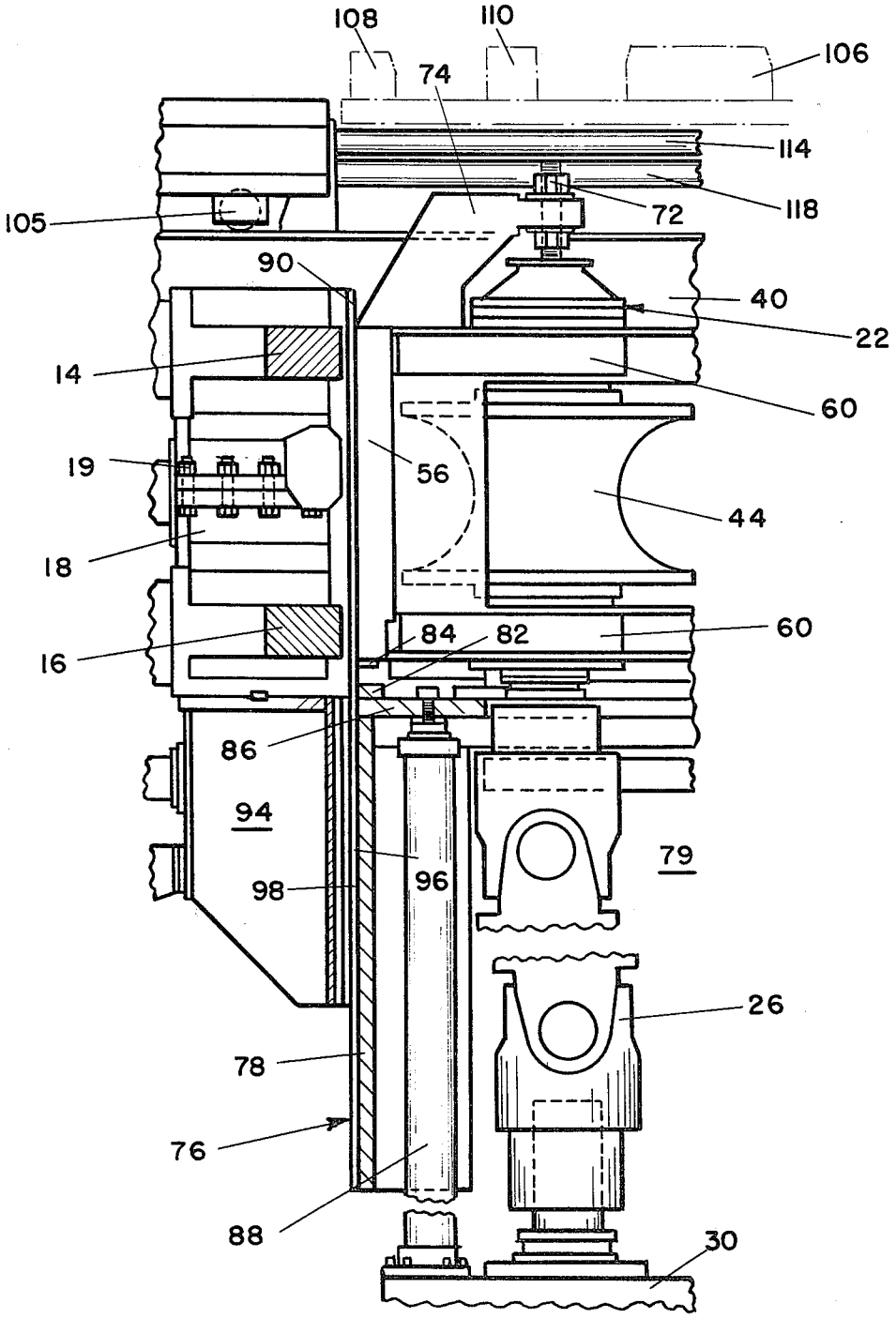
FIG. 5 is an elevational view, partly in section, of the left-hand portion of the stand including the related roll assembly, and associated elements as one views FIG. 1.
Figure 6:
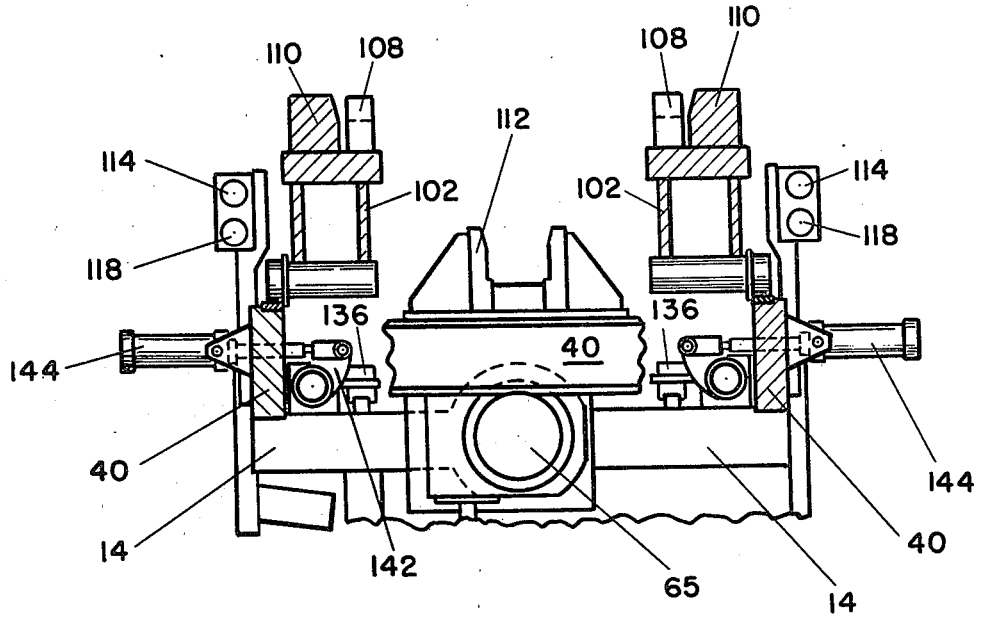
FIG. 6 is a partial sectional view of the upper portion of the mill stand.
Figure 7:
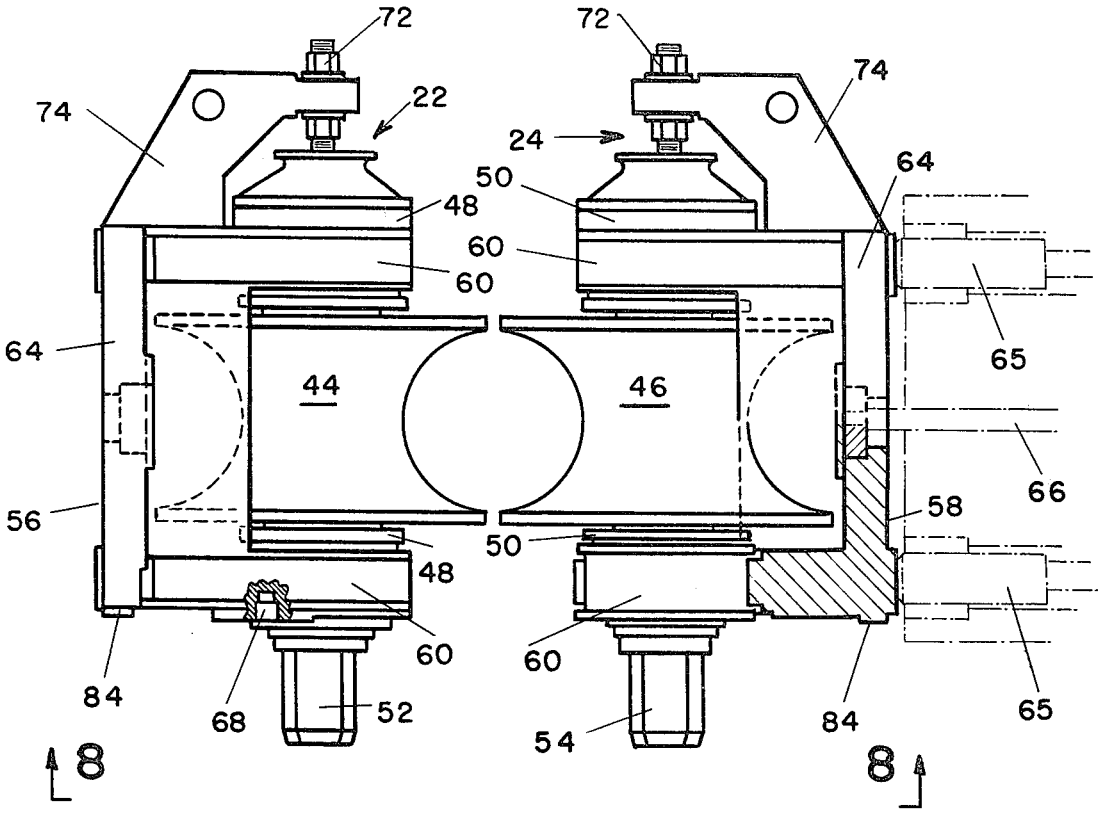
FIG. 7 is an enlarged elevational view, partly in section, of a roll set including the supporting chocks for each roll.
Figure 8:
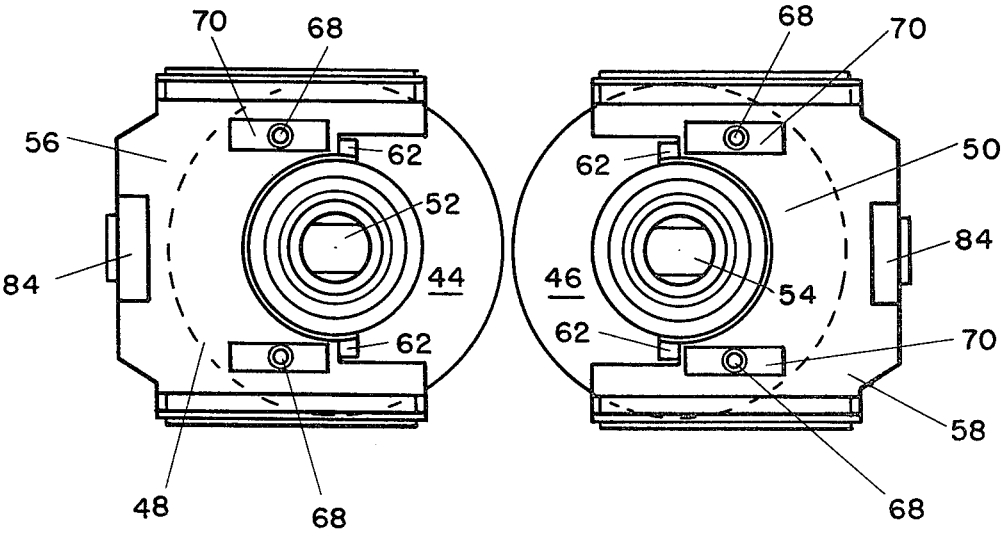
FIG. 8 is a plan view of the roll set shown in FIG. 7 taken on lines 8—8 of FIG. 7.

Describing now more in detail the roll assemblies 22 and 24, reference is made to FIGS. 3 through 8 inclusive. A quick appreciation of the roll assemblies can be gained from FIGS. 7 and 8. The roll assemblies have grooved rolls 44 and 46 and end journals for receiving bearing-chock assemblies 48 and 50 respectively identified in FIG. 8 as to the lower assemblies. The lower ends of the roll as seen in FIG. 7 have driving extensions identified as portions 52 and 54 that allow the rolls to be received by the upper coupling of the spindles 26 and 28 in a torque transmitting relationship. FIGS. 3 and 8 give a better representation of the formation of these ends, and the desired angular position that the ends take when brought into the stand during roll changing.

The roll assemblies 22 and 24 with their bearing-chocks are carried by and moved with yokes 56 and 58, respectively, each yoke having two enlarged journal receiving portions 60 for the bearing-chock assemblies 48 and 50 of the roll. As seen from FIG. 8, the latter assemblies are secured to the yokes by caps 62 bolted to the chocks. The yokes also have outer vertical posts 64 for cooperating with power driven screws 65 and pull-back mechanism for the rolls. The screws 65 and the piston rod of the pullback piston cylinder assembly 66 are shown in phantom in FIG. 7 as to the yoke 58, and to some extent, less fully in FIGS. 1 and 3.

In still referring to FIGS. 7 and 8, special attention is directed to the two pilot holes 68 provided in each underneath side of yokes 56 and 58, which are formed in blocks 70 best illustrated in FIG. 8. In FIG. 7 there is shown the screw double nut assemblies 72 for adjusting each roll 44 and 46 to obtain and maintain the rolls in their proper vertical position relative to each other when the roll-yoke assemblies are installed in the stand 10. As shown, these adjustment mechanisms are supported by brackets 74 which are identical parts of their respective yokes.

Figure 4:
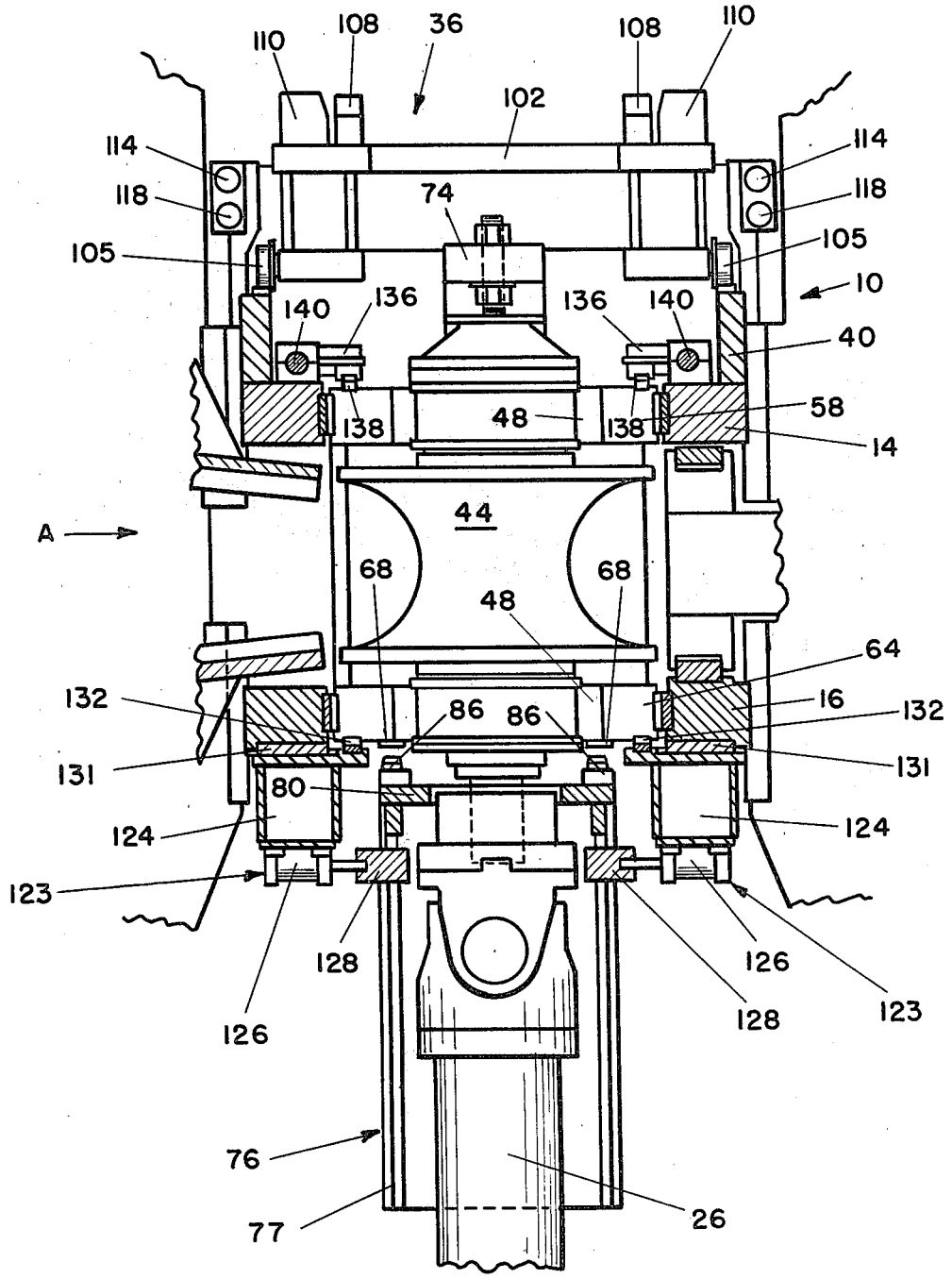
FIG. 4 is a sectional view taken on lines 4—4 of FIG. 1.

Directing attention now to FIGS. 4 and 5 which will be used to describe an elevator 76, this device takes the general form of two upright U-shaped frames 78 joined together at the top by a separator 80 which has an elongated central opening to accommodate the associated portions of the rolls 44 and 46 and upper couplings which pass through the opening. Also, as shown in FIG. 5, there are front and back openings 79 formed in the elevator that avoids obstruction with the spindles 26 and 28. The elevator at its two opposite ends, as one views FIG. 5, is provided with carrying pads 82 at each end which, when the elevator is in its carrying position engages corresponding relatively long centrally located pads 84 arranged at the bottom of the yokes, one of which is shown at the left of FIG. 5, although both are shown in FIG. 7. To assure proper contact and stability the upper surface of the separator 80 is provided with four protruding pins 86, two of which are shown best in FIG. 4, which pass into the pilot openings 68 provided in the yokes 56 and 58.

In the operating condition of the mill, which is the condition shown in the drawing, except for FIG. 3, the elevator 76 is positioned below the adjacent portions of the yokes and more particularly the carrying pads 82 and the pins 86 are held out of contact from the associated yokes whereby the yokes and rolls are free to be adjusted horizontally by the screws 65. The elevator is raised and lowered by two parallelly arranged piston cylinder assemblies 88, one of which is shown in FIG. 5 which are located outside of the spindles 26 and 28 as one views FIG. 1, and which are mounted at their lower ends in the upper surface of the case of the gear drive 30, and at their upper ends the pistons thereof are connected to the separator 80 of the elevator 76.

To assure proper control in the horizontal adjustment of the roll yokes relative to the housings 14 and 16, there is provided, in accordance with customary design, liners in the housings for engaging the yokes. In addition to accommodating the vertical movement of the yokes, and particularly to effect roll changing in accordance with the present invention, the housings are provided with at their extreme outer portions as shown in FIG. 5 where the two opposite sections 18 are located and on the inside of these sections, a pair of spaced apart vertically arranged continuous liners 90, a pair for each housing for contacting two cooperative vertical surfaces of each yoke formed on the vertical outer portion 64 of the yokes, the surfaces being best shown in FIG. 3 and which are identified by reference No. 92.

The liners 90 extend below the lower housing 16 so as not only to provide vertical guide control for the yokes passing through the housings 14 and 16, but also to provide similar guiding for the elevator 76. More particularly it will be noted that below the sections 18 of the housings as one views FIG. 5, opposed guide frames 94 are provided, each having a guiding surface 96 which surfaces serve as extensions of the liners 90 and which are engaged by cooperating surfaces 98 provided on the adjacent portions of the elevator 76. The length of the surfaces 98 of the elevator are made long enough to assure proper stability when the elevator is raised to its extreme upper position where only the lower portion of the surfaces 98 are in guiding contact with the liners 90 of the stand 10.

The four liners 90 both with respect to their location in the stand 10 and in the frames 94 are shown in FIG. 3 where there is also illustrated the employment of L-shaped guiding members 100 mounted on the elevator 76 and the frames 94. Also FIG. 3 shows the roll changing position of the roll 46 in which connection it will be noted that the back of the portion 64 of the yoke 58 is shown in engagement with the pair of liners 90.

In now directing attention to the side shifting roll changing device 34, reference is made to FIGS. 2, 4, 5 and 6. FIG. 2 illustrates that the carriage, and in this case the carriage 38 shown in plan take the form of a U-shaped frame 102 having its opening 104 at the end adjacent the window 20 of stand 10 so that the carriages 36 and 38 can be moved under a pair of roll-yoke assemblies supported by the elevator 76 above the window without interference with the elevator or the roll-yoke assemblies since these members will pass into the opening of the frames 102.

Each frame 102 as shown in FIG. 2 as to the carriage 38, is provided with two pairs of end wheels 105 freely rotatable mounted on horizontally arranged axles and which engage on different sides of the housing 114 the pair of parallelly arranged rails 40 carried by the upper housing 14 as best shown in FIG. 4 and also by the supports 42 shown only in FIG. 1. A proper depth perception of the carriages can be gained from FIG. 4 where the unitized construction is evident, their relationship to the rails 40 and the fact that the width of the elevator 76 is designed to be less than the transverse dimension of the opening of the frames 102.

For proper support and registry of the roll-yoke assemblies the carriages 36 and 38 are at the upper surfaces of the frame 102 provided with a number of support members which are best shown in FIGS. 2, 4 and 5. Referring to FIG. 2 there is shown along the inside of each frame 102 and immediately adjacent its opening on each side in-lined members 106, the outer ones thereof have flat supporting surfaces for engaging and supporting the roll-chock assemblies. The central member 106 is enlarged vertically as seen best in phantom in FIG. 5 which member fits between the opening formed by the opposite yokes when the latter are supported by the elevator. This registry is aided by end tapers formed on the central member as can also be seen in FIG. 5. At the opposite ends of this same area are tapered blocks 108, the taper being such so as to cause the yokes when engaged thereby to be urged into a proper longitudinal position on the carriage. For obtaining proper registration in the transverse direction of the carriages, four additional blocks 110 are provided which also have tapered inner surfaces, the tapers thereof being best shown in FIG. 4, while the taper of the blocks 108 can be seen in phantom in FIG. 5.

With reference to FIGS. 2 and 6, it will be observed that connected to the inside of the rails 40, and extending transversely thereof are two spaced apart lower roll end engaging frames 112 which receive the flat sides of the driven ends of the rolls to assure that these sides will be in proper registry with the couplings of the spindles 26 and 28 when the roll-yoke assemblies are lowered into the couplings. As noted before, FIG. 3 illustrates as to the roll 44, the desired angular position of the lower end of the roll.

The carriages 36 and 38 are traversed by the arrangement of piston cylinder assemblies 114 and 118 respectively, carried by the upper housing 14, which are best shown in FIGS. 2 and 5. The piston cylinder assemblies are mounted on each side of the stand 10, one above the other with their pistons extending in opposite directions. The pistons 120 of the piston cylinder assemblies are connected to the back of the carriages on each side of brackets 122. The strokes of the piston cylinder assemblies, of course, are designed to bring the associated carriages 36 and 38 from a position clear of the window 20 to a position directly over it.

As noted above, it is one of the features of the present invention to allow for the automatic registry of the lower end of the rolls 44 and 46 into the couplings of the spindles 26 and 28 when the rolls are lowered into the stand 10. In order to assure that the spindles will be in the proper predetermined vertical roll changing position the spindles are provided with opposite spindle positioners 123 shown best in FIG. 4. Extending downwardly from the lower housing 16 outside the elevator 76 are opposed rollout frames 124, the lower portions of which each carry piston cylinder assemblies 126, the pistons of which are connected to spindle engaging members 128. On each side one member 128 engages the adjacent sides of both spindles. To assure proper movement of the members 128, on either side of the piston cylinder assembly a pair of guide rod assemblies 130 are provided, two of which are shown in FIG. 3. The design of the members 128 is such that when the piston cylinder assemblies are operating they will cause engagement by the members 128 with the spindles on both sides thereof thereby to hold the spindles in the proper vertical roll changing position.

FIGS. 2, 3, 4 and 6 illustrate best the members provided for effectively and quickly supporting, engaging and disengaging the roll-yoke assemblies with respect to the housings 14 and 16. It will be first noted in FIG. 4 that the lower housing 16 and the yoke are provided with pads 131 and 132 respectively, which engage the upper portion of the frames 124 of the stand 10, thereby separately supporting the weight of the housing assembly and roll-yoke assemblies during operation of the mill. On the delivery side of the mill, i.e., opposite to the side of the arrow A shown in the drawing and particularly in FIG. 3, the housings 14 and 16 are on their opposite inner window sides provided with yoke engaging surfaces 132.

At the top of the mill and more particularly as seen in FIGS. 2, 4 and 6, the yokes 56 and 58 are engaged by holddown arms 136 carried by the upper housing 14 as seen in FIG. 6, the holding contact being made by the pads 138 provided on the yokes and arms. The arms 136 are connected to and adapted to be rotated by shafts 140 which are rotated in turn by brackets 142 connected to piston cylinder assemblies 144, one for each side as shown in FIG. 2 where it will be seen that the piston cylinder assemblies 144 are mounted at the one end of the shafts 140, so that the hold-down portions of the arms 136 are divided into two identical sections. It will be noted in FIG. 6 that the rods of the piston cylinder assemblies 144 pass through the rails 40.

In now briefly describing the roll changing sequence of the above described mill, let it be assumed that a pair of roll-yoke assemblies 22 and 24 arranged in the stand 10 are to be removed and the replacement set of roll-yoke assemblies are positioned on the carriage 38 as shown in phantom in FIG. 1. Let it also be assumed that the spindles 26 and 28 and the roll assemblies 22 and 24 themselves have been positioned in the roll changing position and that the pullback piston cylinder assembly mechanisms 66 have been disengaged from the yokes 56 and 58 so that the yokes are in engagement with the liners 90. Further it will be assumed that the hold down arms 136 have been disengaged from the yokes. In this event the piston cylinder assemblies 88 of the elevator 76 are operated to cause the members 82 and the pins 86 of the elevator to engage the corresponding portions of the yokes 56 and 58 to effect the raising of the roll-yoke assemblies as a unit to a position where the assemblies are above the mill stand 10 and above the upper roll-yoke assembly engaging surfaces of the carriage 36.

While the used roll-yoke assemblies are so positioned the piston cylinder assemblies 114 are operated to advance the empty carriage 36 to a position directly under the raised pair of roll-yoke assemblies thereupon the elevator 76 is lowered to cause the lower portions of the yokes 56 and 58 of the used roll-yoke assemblies to come in contact with the members 106, 108 and 110 of the carriage 36 thereby automatically transferring and registering the roll-yoke assemblies on the carriage 36. At this point the carriage 36 can be withdrawn and immediately thereafter piston cylinder assemblies 118 of the carriage 38 are operated to bring this carriage with the new roll-yoke sets to a position immediately above the window 20 of the stand 10 and above the waiting adjacent elevator 76. At this point the operation is reversed and the elevator is lowered to position the new roll-yoke sets into the mill.

In accordance with the provisions of the patent statutes, I have explained the principle and operation of my invention and have illustrated and described what I consider to represent the best embodiment thereof.

I claim:

1. In a rolling mill or the like having a stand for receiving a pair of cooperative rolls arranged to rotate about parallel vertical axes, a vertical opening in said stand for allowing one or both of said rolls to be moved and replaced through the top thereof, means for raising and lowering a roll or pair of rolls in said stand relative to a position above said opening, and displaceable means arranged normal to said vertical axes at the top of said stand for receiving and supporting a raised roll or pair of rolls and for removing said raised roll or pair of rolls away from said opening and for positioning a replacement roll or pair of rolls over said opening in readiness to be lowered into said opening and into said stand.

2. In a rolling mill or the like according to claim 1 wherein support means is carried by said stand for supporting said displaceable means.

3. In a rolling mill or the like according to claim 2 wherein said support means comprises a pair of horizontally spaced rails carried by said stand, and wherein said displaceable means includes wheel members engageable with said rails during its displacement.

4. In a rolling mill or the like according to claim 1 wherein said displaceable means further comprises a separate support carriage for a first pair of rolls and a second support carriage for a replacement pair of rolls, and separate means for displacing at different times said carriages toward and away from said opening in said stand.

5. In a rolling mill or the like according to claim 4 wherein said carriage includes support members for said pair of rolls and registering means for assuring the pair of rolls when received by said carriage will be positioned in a predetermined manner.

6. In a rolling mill or the like according to claim 1 wherein each said roll is received in and moveable with a yoke received in said opening of said stand, means carried by said stand for moving at least one roll normal to its vertical axis toward and away from the other said roll, and wherein said stand includes means for guiding said yokes during said raising and lowering movement in said opening.

7. In a rolling mill or the like according to claim 6 wherein said stand includes two spaced apart parallel horizontally arranged housings, each said housing having complementary in-lined vertical openings that constitute said first mentioned opening, said yokes received in said complementary openings in which each yoke has bearing-chock receiving portions in a different complementary opening of said housings for supporting opposite end journals of an associated roll in a manner that said housings receive the rolling loads of the rolls.

8. In a rolling mill or the like according to claim 7 wherein said raising and lowering means includes an elevator means arranged below the roll-yoke sets when said sets are arranged in their operative rolling positions in said mill, said elevator means including means for engaging both roll-yoke sets for raising and lowering them as a unit relative to said housings, and in which in its raised position said elevator means is adapted to extend through the uppermost housing, said raising and lowering means and said elevator means is constructed and arranged so that said elevator means is positionable out of contact with said roll-yoke sets when the latter are in their operative rolling positions.

9. In a rolling mill or the like according to claim 8 wherein said means for guiding includes means for guiding said elevator means when the latter is raised and lowered relative to said housings.

10. In a rolling mill or the like according to claim 9 wherein said elevator means includes registry means, and said means for raising and lowering includes piston cylinder assembly means having means for registering with said registry means of said elevator means when the means for registering is brought into engagement with the registry means for raising and lowering the elevator means relative to said housings.

11. In a rolling mill or the like according to claim 7 wherein said mill including means for supporting said roll-yoke sets when arranged in their operative rolling positions in said stand, and clamping means carried by said stand and engageable with the uppermost surfaces of said roll-yoke sets to prevent the sets from moving upwardly on said stand.

12. In a rolling mill according to claim 11, said clamping means further comprising:

arm means arranged to overhang in their operative position the uppermost surfaces of said yoke, means mounted on said uppermost housing for pivotally supporting said arm means, shaft means connected to said arm means for causing said arm means to be brought from an inoperative position clear of said yokes to an operative position in holding relationship with said yokes, and power means connected to said shaft means for effecting said movement.

13. In a rolling mill according to claim 12 wherein said arm means is arranged along the two longitudinal sides of said opening in said stand and wherein there is provided on both of said sides one of said clamping means, and further where each said arm means having a substantial length so as to engage a substantial portion of said adjacent surfaces of said yokes.

14. In a rolling mill or the like according to claim 1 including for each roll, generally vertically arranged spindle means arranged at the bottom of said stand for driving said rolls when in their operative positions in said stand, and means for positioning said spindle means in a predetermined vertical position before a replacement roll or pair of rolls is lowered into said stand so that the roll or pair of rolls will be automatically received in a driving relationship with an associated spindle means when lowered in said stand.

15. In a rolling mill or the like having a stand for receiving a pair of cooperative rolls arranged to rotate about parallel vertical axes, a vertical opening in said stand for allowing both of said rolls to be moved and replaced as a unit through the top thereof, means for raising and lowering a pair of rolls in said stand relative to a position above said opening, displaceable means arranged normal to said vertical axes at the top of said stand for receiving and supporting a raised pair of rolls and for removing said raised pair of rolls away from said opening and for positioning a replacement pair of rolls over said opening in readiness to be lowered into said opening, wherein each said roll is received in and moveable with a yoke received in said opening of said stand, means carried by said stand for moving at least one roll-yoke set normal to its vertical axis toward and away from the other said roll-yoke set, said stand includes means for guiding said yokes during said raising and lowering movement in said opening, said displaceable means further comprises a separate support carriage for a first pair of rolls and a second support carriage for a replacement pair of rolls, and separate means for displacing at different times said carriages toward and away from said opening in said stand, each of said carriages including support members for a cooperative pair of roll-yoke sets and registering means for assuring a pair of cooperative roll-yoke sets, when received by said carriage will be positioned in a predetermined manner, said registry means further comprising projecting means constructed and arranged to be engaged by the adjacent opposite surfaces of the yokes when a pair of cooperative roll-yoke sets thereof are transferred to a carriage.

* * * * *